US009547257B2

(12) United States Patent
Matsumoto et al.

(10) Patent No.: US 9,547,257 B2
(45) Date of Patent: Jan. 17, 2017

(54) DEVELOPER PUMP WITH RESTRICTED DETECTION TIME AND IMAGE FORMING DEVICE

(71) Applicants: Junichi Matsumoto, Kanagawa (JP); Kiyonori Tsuda, Kanagawa (JP); Nobuo Takami, Kanagawa (JP); Yutaka Takahashi, Kanagawa (JP); Kentaro Mikuniya, Tokyo (JP); Keinosuke Kondoh, Kanagawa (JP); Akihiro Kawakami, Tokyo (JP); Toshio Koike, Tokyo (JP)

(72) Inventors: Junichi Matsumoto, Kanagawa (JP); Kiyonori Tsuda, Kanagawa (JP); Nobuo Takami, Kanagawa (JP); Yutaka Takahashi, Kanagawa (JP); Kentaro Mikuniya, Tokyo (JP); Keinosuke Kondoh, Kanagawa (JP); Akihiro Kawakami, Tokyo (JP); Toshio Koike, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/547,574

(22) Filed: Nov. 19, 2014

(65) Prior Publication Data

US 2015/0139671 A1 May 21, 2015

(30) Foreign Application Priority Data

Nov. 21, 2013 (JP) ..... 2013-240775
Aug. 18, 2014 (JP) ..... 2014-165797

(51) Int. Cl.
*G03G 15/08* (2006.01)

(52) U.S. Cl.
CPC ..... *G03G 15/0879* (2013.01); *G03G 15/0858* (2013.01)

(58) Field of Classification Search
CPC ..... G03G 15/0879; G03G 15/0858; G03G 15/0856; G03G 15/0865; G03G 15/0877
USPC ..... 399/27, 258, 260, 255
See application file for complete search history.

(56) References Cited

U.S. PATENT DOCUMENTS

2009/0324298 A1 12/2009 Katsuyama et al.
2012/0051792 A1 3/2012 Matsumoto et al.
2012/0057890 A1 3/2012 Takuma et al.
(Continued)

FOREIGN PATENT DOCUMENTS

JP 2005-082848 3/2005

*Primary Examiner* — Benjamin Schmitt
*Assistant Examiner* — Matthew Miller
(74) *Attorney, Agent, or Firm* — Harness, Dickey & Pierce, P.L.C.

(57) ABSTRACT

An image forming apparatus includes a developer conveyance device to transport developer, using a positive-displacement pump to alternately generate positive pressure and negative pressure by changing a volume of an internal space thereof, a destination developer container to which the developer conveyance device transports developer, a sensor provided to the destination developer container, to detect developer in the destination developer container, and a controller to control the positive-displacement pump according to a detection result generated by the sensor. The controller disabled detection of developer by the sensor in a non-detection period that starts from a stop of the positive-displacement pump.

14 Claims, 7 Drawing Sheets

(56) References Cited

U.S. PATENT DOCUMENTS

| | | | | |
|---|---|---|---|---|
| 2012/0063814 | A1* | 3/2012 | Otome | G03G 15/0822 399/258 |
| 2012/0070195 | A1 | 3/2012 | Ichikawa et al. | |
| 2012/0114349 | A1 | 5/2012 | Matsumoto et al. | |
| 2013/0266345 | A1* | 10/2013 | Matsumoto | G03G 15/0832 399/258 |
| 2013/0322927 | A1 | 12/2013 | Matsumoto et al. | |
| 2014/0133889 | A1 | 5/2014 | Matsumoto et al. | |
| 2015/0071659 | A1* | 3/2015 | Iikura | G03G 21/1676 399/27 |

* cited by examiner

DEVELOPER PUMP WITH RESTRICTED DETECTION TIME AND IMAGE FORMING DEVICE

CROSS-REFERENCE TO RELATED APPLICATIONS

This patent application is based on and claims priority pursuant to 35 U.S.C. §119(a) to Japanese Patent Application Nos. 2013-240775 filed on Nov. 21, 2013 and 2014-165797 filed on Aug. 18, 2014 in the Japan Patent Office, the entire disclosure of each of which is hereby incorporated by reference herein.

BACKGROUND

Technical Field

Embodiments of the present invention generally relate to a developer conveyance device and an electrophotographic image forming apparatus, such as a copier, a printer, a facsimile machine, or a multifunction peripheral (MFP) having at least two of copying, printing, facsimile transmission, plotting, and scanning capabilities, that includes the developer conveyance device.

Description of the Related Art

In electrophotographic image forming apparatuses, it is proposed to use a positive-displacement pump to transport developer that is either toner or a mixture of toner and carrier (hereinafter simply "developer"). Positive-displacement pumps generate pressure by repeatedly varying the volume of an inner space, use the pressure to bring in air or powder from outside on the upstream side, and give discharge energy thereto, thereby discharging the air or powder downstream. Typical positive-displacement pumps include diaphragm pumps, piston pumps, and bellows pumps.

The force for transporting developer (through a conveyance channel such as a pipe) using a positive-displacement pump varies depending on the distance of transportation and the height by which developer is lifted (lifting height). The force increases as the distance and the lifting height increase. Additionally, the strength of force varies depending on the state of developer in the conveyance channel. The force increases as the amount of developer in the conveyance channel increases. The pressure generated by the pump (i.e., capability) is made greater than the force for transport of developer. To increase the capacity of the diaphragm pump, one or more of the size of the pump, the stroke of the diaphragm, the frequency of rotation, and the like are increased. Thus, the device becomes bulkier, and the cost increases.

The following approach is conceivable to maintain the capability to transport developer by the developer conveyance device. For example, developer discharged from the developer container is stored temporarily in a reservoir adjacent to the developer container and stirred by an agitator in the reservoir so that developer contains air and thus fluidized. Then, a pump sucks in and transports the developer. Discharge of developer from the developer container is controlled using a sensor attached to a side wall of the reservoir to keep the amount of developer in the reservoir substantially constant. With this control, the pressure applied to a suction inlet of the reservoir can be substantially constant, and then the amount of developer sucked in by the pump can be constant.

SUMMARY

An embodiment of the present invention provides an image forming apparatus that includes a developer conveyance device to transport developer, using a positive-displacement pump to alternately generate positive pressure and negative pressure by changing a volume of an internal space thereof; a destination developer container to which the developer conveyance device transports developer; a sensor provided to the destination developer container, to detect developer in the destination developer container; and a controller to control the positive-displacement pump according to a detection result generated by the sensor. The controller disables detection of developer by the sensor during a non-detection period that starts from a stop of the positive-displacement pump.

Another embodiment provides a developer conveyance device to transport developer to a destination developer container. The developer conveyance device includes the above-described sensor and the above-described positive-displacement pump. The positive-displacement pump is controlled according to a detection result generated by the sensor, and Detected by the sensor is disabled during a non-detection period that starts from a stop of the positive-displacement pump.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
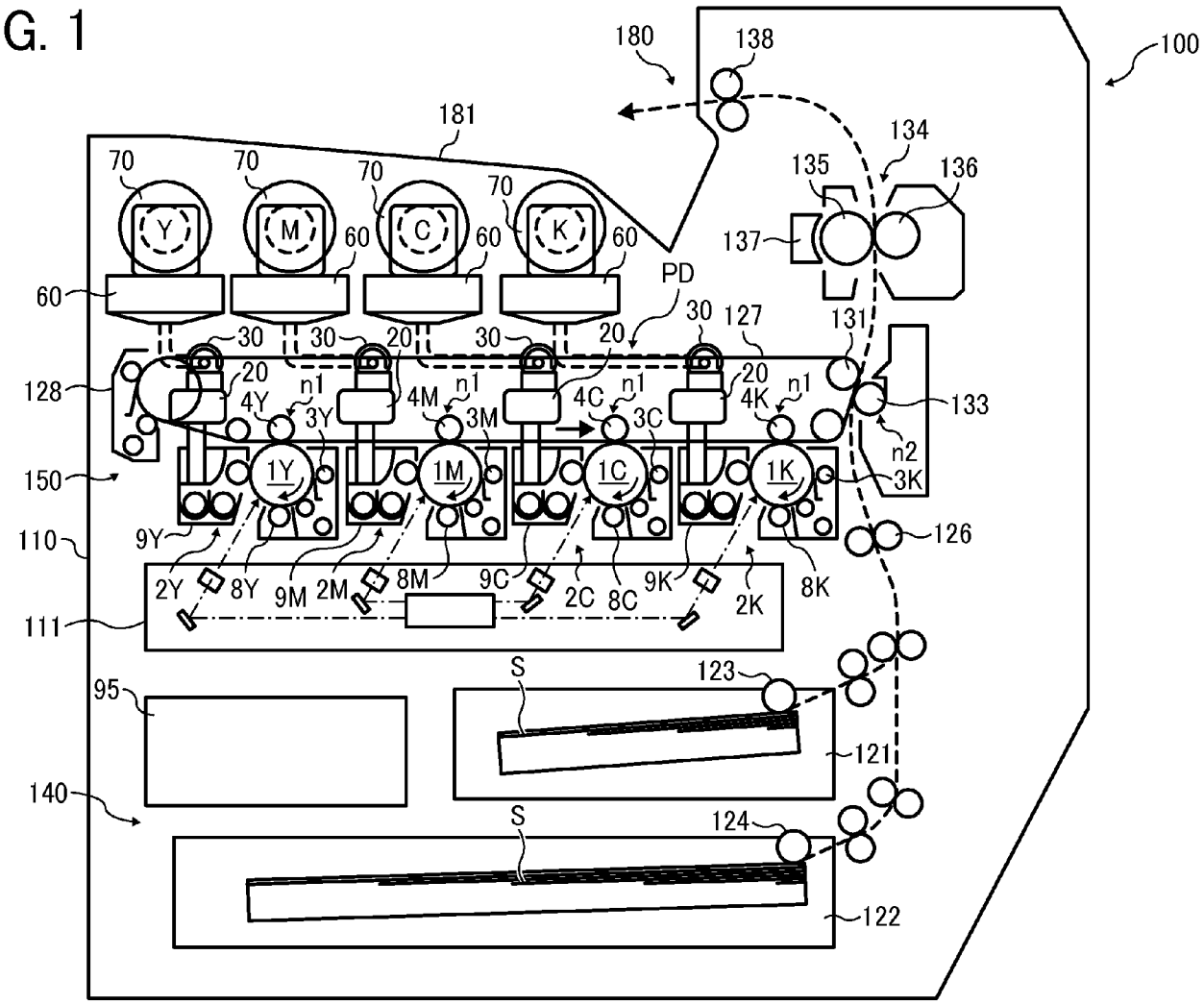
FIG. 1 is a schematic view of an entire image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. Further, the order of steps in control procedures is not limited to the order in which the steps are mentioned in this specification.

Referring now to the drawings, wherein like reference numerals designate identical or corresponding parts throughout the several views thereof, and particularly to FIG. 1, a multicolor image forming apparatus according to an embodiment of the present invention is described.

FIG. 1 illustrates a schematic configuration of an electrophotographic image forming apparatus, which in the present embodiment is a tandem multicolor printer of intermediate transfer type.

An image forming apparatus 100 shown in FIG. 1 includes an apparatus body 110, a sheet feeding unit 140, an image forming assembly 150, and a paper ejection section 180. The sheet feeding unit 140 is positioned in a lower portion of the apparatus body 110 and includes sheet feeding trays 121 and 122 to contain sheets S of recording media and a mechanism to feed the sheets S to the image forming assembly 150. The sheet feeding trays 121 and 122 are arranged vertically. The image forming assembly 150 is positioned in a center portion of the apparatus body 110 and has an image forming capability. The paper ejection section 180 is positioned in an upper portion of the apparatus body 110 and includes a pair of paper ejection rollers 138 to discharge sheets S on which images are formed and a discharge tray 181 on which the sheets S are stacked.

The image forming assembly 150 includes an endless intermediate transfer belt 127 serving as an intermediate transfer member. Beneath the intermediate transfer belt 127, four image forming units 2Y, 2M, 2C, and 2K are disposed in that order in the direction indicated by arrow in FIG. 1, in which the intermediate transfer belt 127 rotates. The image forming units 2Y, 2M, 2C, and 2K form yellow, magenta, cyan, and black images and have a similar configuration except the color of developer used in image formation. Therefore, in the descriptions below and the drawings, suffixes Y, M, C, and K representing the colors of toner and attached to reference numerals of the image forming units and developing devices are omitted when color discrimination is not necessary.

The image forming unit 2 includes a photoconductor 1 and components disposed therearound, namely, a charging device 8, a developing section 9, a primary-transfer section n1 including a transfer roller 4, and a cleaning unit 3. The photoconductor 1 is a drum-shaped rotatable body and serves as an image bearer.

The developing section 9 develops a latent image on the photoconductor 1 with two-component developer including toner (yellow toner in a case of the developing section 9Y) and carrier. A main component of the developing section 9 is a developing device 10 shown in FIG. 2. In image formation, toner images are formed on the photoconductor 1 through image forming processes, namely, charging, exposure, developing, transfer, and cleaning processes.

The photoconductor 1 is rotated clockwise in FIG. 1 by a driving unit and is charged uniformly by the charging device 8 (charging process). Subsequently, an optical writing unit 111 disposed beneath the image forming unit 2 directs laser light according to image data to the photoconductor 1, and thus an electrostatic latent image is formed on a surface of the photoconductor 1 (exposure process). The optical writing unit 111 serves as an exposing device. As the photoconductor 1 rotates, the electrostatic latent image thereon reaches a position facing the developing section 9, where the electrostatic latent image is developed into a toner image with toner included in the developer supplied from the developing section 9 (developing process). The toner image on the photoconductor 1 is then transferred onto the intermediate transfer belt 127 at a position (primary-transfer nip) facing the primary-transfer section n1 that includes the inter mediate transfer belt 127 and the transfer roller 4 (primary-transfer process). The surface of the photoconductor 1 from which the toner image is transferred is cleaned where the photoconductor 1 faces the cleaning unit 3 (cleaning process). After the cleaning process, a discharger initializes potentials of the surface of the photoconductor 1. Thus, a sequence of image forming processes performed on the photoconductor 1 is completed. The above-described image forming processes are performed in each of single color image formation to form single color images (or monochrome images) and multicolor (e.g., full-color) image formation. In multicolor image formation, the above-described processes are performed in each of the image forming units 2Y, 2M, 2C, and 2K. Then, the respective toner images are transferred from the photoconductors 1 and superimposed one on another on the intermediate transfer belt 127 as a multicolor (e.g., full-color) image.

Then, the intermediate transfer belt 127 carrying the multicolor toner image reaches a position (secondary-transfer nip) facing a secondary-transfer section n2 19 that includes secondary-transfer rollers 131 and 133. The multicolor toner image on the intermediate transfer belt 127 is transferred onto the sheet S transported to the secondary-transfer nip.

In the sheet feeding unit 140 to feed the sheet S to the secondary-transfer nip, the multiple sheets S are contained in the sheet feeding trays 121 and 122 that are arranged vertically. The sheets S contained in the sheet feeding trays 121 and 122 are different in size. The sheets S in the sheet feeding tray 121 or 122 are sent out one by one by sheet feeding roller 123 or 124 cooperating with a separating device. The sheet S is guided by a train of rollers and stopped by a pair of registration rollers 126. After skew of the sheet S is adjusted, the registration rollers 126 forward the sheet S to the secondary transfer nip, timely.

Subsequently, the sheet S onto which the multicolor image is transferred is transported to a fixing device 134 that includes a fixing roller 135 heated by electromagnetic induction exerted by an induction heating (IH) coil 137. In the fixing device 134, the multicolor toner image is fused by heat and pressure exerted by fixing roller 135 and a pressure roller 136 and fixed on the sheet S. Then, a pair of paper ejection rollers 138 discharges the sheet S to a paper ejection tray 181 on an upper face of the apparatus body 110. Thus, a sequence of image forming processes performed in the image forming apparatus 100 is completed. It is to be noted that, in FIG. 1, reference numeral 128 denotes a cleaning unit to clean the intermediate transfer belt 127, and 95 represents a controller.

In the image forming apparatus 100 according to the present embodiment, the developing section 9 includes a developer conveyance device 190 in addition to the developing device 10.

Figure 2:
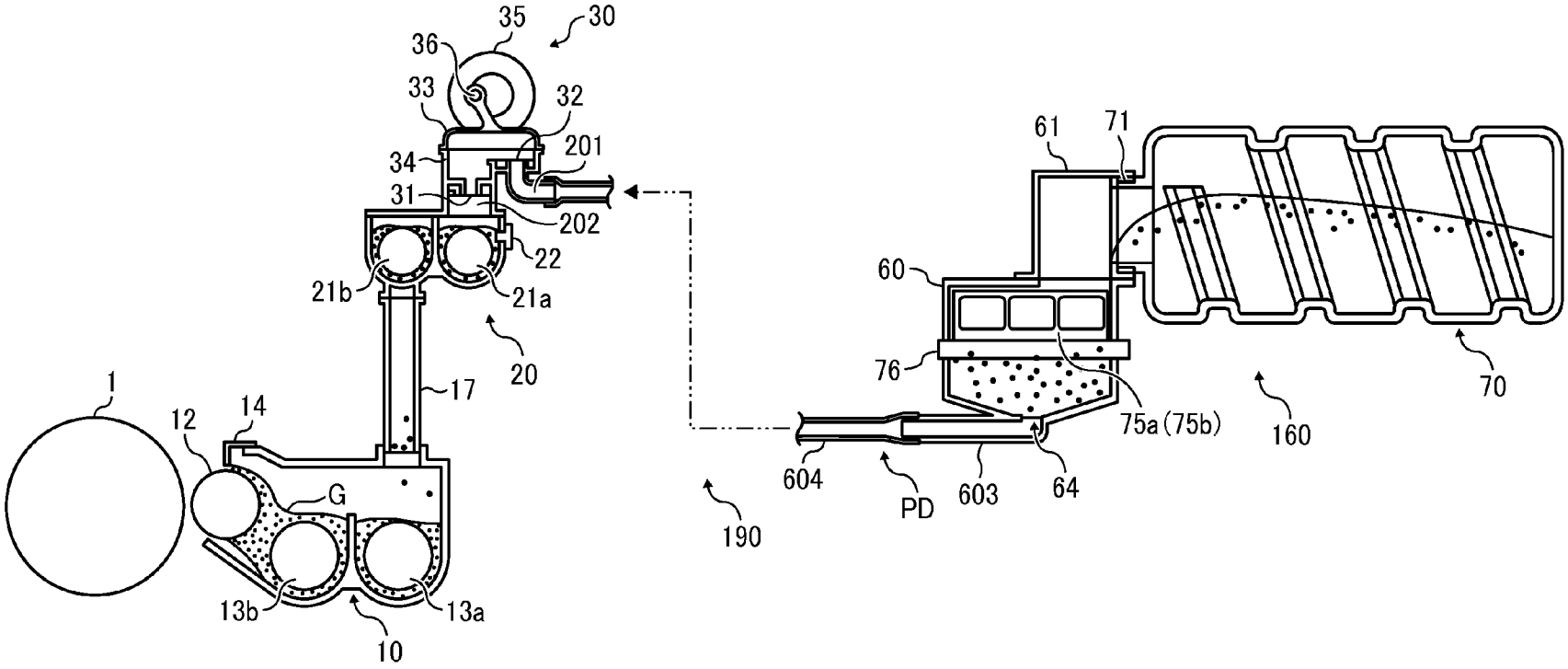
FIG. 2 is a conceptual diagram of a developing section in the image forming apparatus shown in FIG. 1.

FIG. 2 is a conceptual diagram of the entire developing section 9. That is, FIG. 2 illustrates the developing device 10, a supply device 160, a conveyance mechanism PD (circulation mechanism), a pump 30, and a sub-hopper 20 that is a hopper to store toner temporarily. It is to be noted that reference character "G" in FIG. 2 represents developer although reference character "G" is omitted in the specification.

The sub-hopper 20 serves as a destination developer container to which the pump 30 transports toner.

The supply device 160 includes a toner reservoir 60 and a toner container 70. The developing device 10 is connected via the conveyance mechanism PD to the supply device 160. The pump 30, the sub-hopper 20, and the like are disposed in midway through the conveyance mechanism PD. These are components of the developer conveyance device 190. It is to be noted that, the developer inside the toner container 70 is hereinafter referred to as toner.

The developing device 10 is opposed to the photoconductor 1. The developing device 10 contains developer (represented by "G" in FIG. 2) including toner and carrier, and conveying screws 13*a* and 13*b* transport and stir the developer. The developer transported by the conveying screw 13*b* is scooped onto a surface of a developing roller 12 due to magnetic force and develops the latent image on the photoconductor 1. A doctor blade 14 regulates the thickness or height of developer on the developing roller 12 before the developer reaches the primary-transfer nip.

When the developing device 10 executes the developing process, the developer conveyance device 190 is driven, and toner is supplied thereto. The sub-hopper 20 to supply toner is disposed, via a vertical pipe 17, above the developing device 10, and toner is stored in the sub-hopper 20 temporarily. First and second conveyance channels 24 and 25 are provided in the sub-hopper 20 and together serve as a toner circulation channel. The first and second conveyance channels 24 and 25 parallel to each other horizontally. In the first and second conveyance channels 24 and 25, screws 21*a* and 21*b* are provided rotatably to transport and circulate the temporarily stored toner. As the screws 21*a* and 21*b* are rotated by a rotation driving system, the toner in the sub-hopper 20 falls under the gravity through the vertical pipe 17 to the developing device 10 while maintaining dispersibility. A toner end sensor 22 is attached to a side wall 20*a* of the sub-hopper 20 to detect that no toner remains in the sub-hopper 20 or the amount of remaining toner is at or below a threshold.

The pump 30 is connected to an upper side of the sub-hopper 20. The pump 30 includes a pump case 34, a diaphragm 33, a suction valve 32 to open and close an inlet 201, and a discharge valve 31 to open and close an outlet 202. The pump 30 is a positive-displacement pump that causes reciprocal displacement of the diaphragm 33 using a diaphragm motor 35 and an eccentric shaft 36 directly connected to the diaphragm motor 35. The pump 30 thus varies the volume of an inner space (i.e., a pump chamber) of the pump 30, thereby alternately generating positive pressure and negative pressure according to the change in volume. The pump 30 is a main component of the developer conveyance device 190 and capable of transporting toner from a given position to a given destination. In the present embodiment, in each drive cycle thereof, the pump 30 sucks in toner from the toner reservoir 60 and transports (discharges) toner to the sub-hopper 20 downstream from the pump 30 in the direction in which the developer conveyance device 190 transports toner.

Figure 3A:
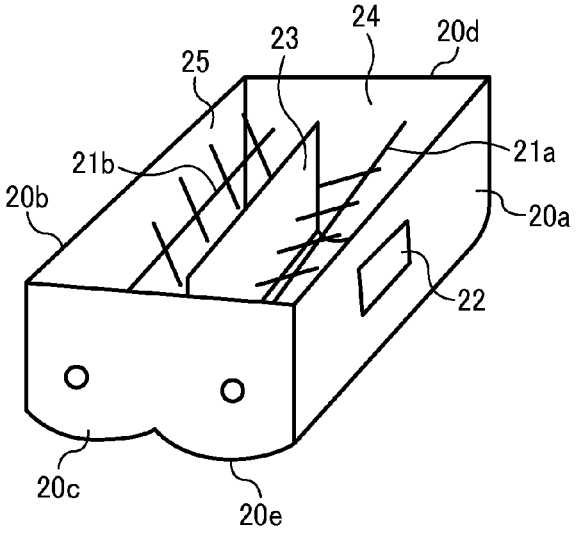
FIG. 3A is a perspective view illustrating a sub-hopper of a developer conveyance device according to an embodiment.
Figure 3B:
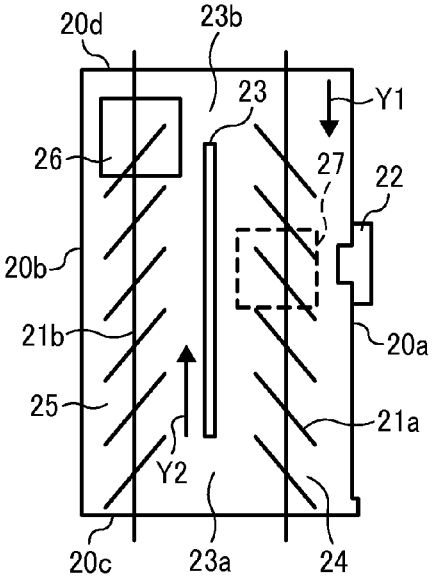
FIG. 3B is a plan view of the sub-hopper as viewed from above.

As shown in FIGS. 3A and 3B, the sub-hopper 20 includes the side wall 20*a*, a side wall 20*b*, and bearing walls 20*c* and 20*d* including bearings of the screws 21*a* and 21*b*. The side walls 20*a* and 20*b* extend parallel to the screws 21*a* and 21*b*. A bottom face 20*e* of the sub-hopper 20 includes two curved faces that parallel to each other. The two curved faces have arc shapes confirming to external shapes of the screws 21*a* and 21*b*, respectively.

The sub-hopper 20 further includes a partition 23 that divides an interior of the sub-hopper 20 into the first conveyance channel 24 provided with the screw 21*a* and the second conveyance channel 25 provided with the screw 21*b*. The partition 23 includes openings 23*a* and 23*b* at both ends in the longitudinal direction thereof. As the screws 21*a* and 21*b* rotate, the toner inside the sub-hopper 20 is transported by the screws 21*a* and 21*b* as indicated by arrows Y1 and Y2 shown in FIG. 3B. Specifically, the toner transported to an end side in the first conveyance channel 24 is forwarded, through the opening 23*a* of the partition 23, to the upstream side in the second conveyance channel 25 in the direction indicated by arrow Y2 (a toner circulation direction). Then, the toner transported to the downstream side in the second conveyance channel 25 is forwarded, through the opening 23*b* of the partition 23, to the upstream side in the first conveyance channel 24 in the direction indicated by arrow Y1. With this action, toner circulates inside the sub-hopper 20.

Toner is discharged from the second conveyance channel 25 through an outlet 26 provided in the bottom face 20*e*, on the downstream side of the second conveyance channel 25 in the direction indicated by arrow Y2. In the present embodiment, the toner discharged from the outlet 26 is transported through the vertical pipe 17 to the developing device 10.

The toner discharged from the outlet 202 of the pump 30 enters an opening 27 provided in a ceiling of the first conveyance channel 24 and reaches an intermediate portion of the first conveyance channel 24 in the longitudinal direction thereof. The opening 27 is positioned above the screw 21*a* in the first conveyance channel 24.

The toner end sensor 22 is provided to the side wall 20*a* that defines the first conveyance channel 24. The toner end sensor 22 is a piezoelectric sensor, for example, and detects the presence of toner when toner contacts a detection face thereof and a predetermined pressure is applied thereto.

Descriptions are given below of relative positions of the toner end sensor 22, which is attached to the side wall 20*a* of the sub-hopper 20, and the pump 30.

Figure 4:
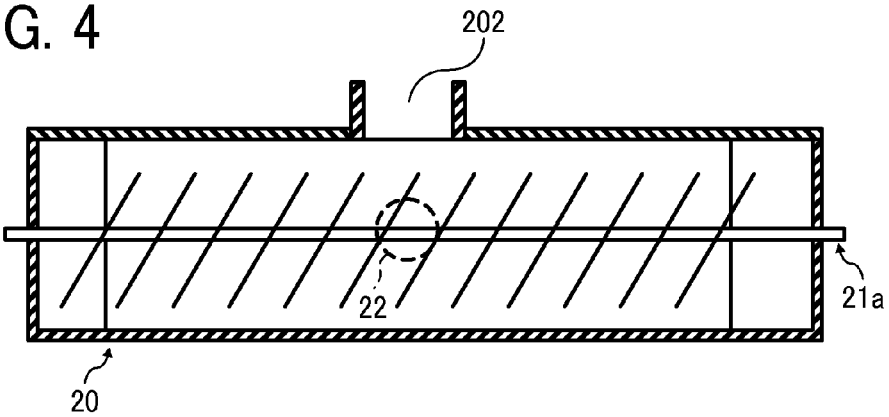
FIG. 4 is a conceptual diagram that illustrates a conveyance channel provided with a sensor in the sub-hopper shown in FIG. 3A.
Figure 5:
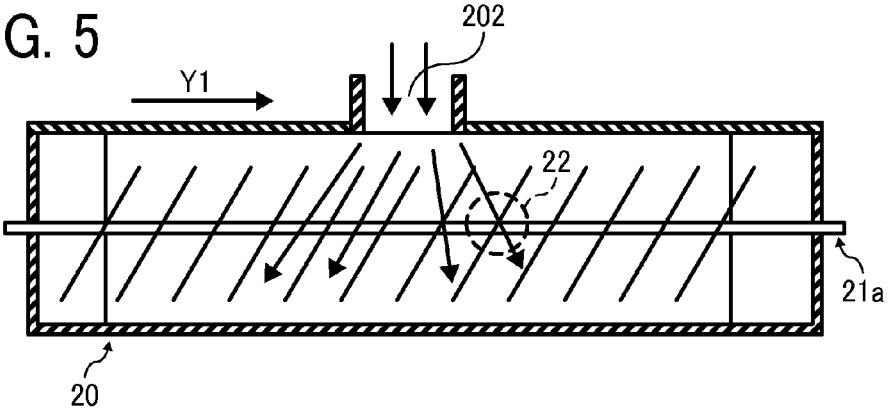
FIG. 5 is a conceptual diagram that illustrates the conveyance channel shown in FIG. 4, in which location of the sensor is shifted from an outlet.

As shown in FIG. 4, the toner end sensor 22 is provided to a face perpendicular to the longitudinal direction of the screw 21*a* and at a position intersecting with a vertical face that passes through either the outlet 202 of the pump 30 or the discharge valve 31 to open and close the outlet 202. That is, on a given vertical face, the position at which the pump 30 discharges toner (i.e., discharge position of the pump 30) substantially coincides with the location of the toner end sensor 22. With an action of the pump 30 (i.e., pumping action), toner flows from the outlet 202 of the pump 30 into the sub-hopper 20 while spreading together with air as indicated by arrows shown in FIG. 5. With the term "substantially coincide with", it is to be understood that the discharge position of the pump 30 includes the range in which the toner thus spreads and flows, and, on the vertical face, the toner end sensor 22 shown in FIG. 5 substantially coincides with the outlet 202 of the pump 30. In FIG. 5, for example, toner moves from the left to the right, and the outlet 202 of the pump 30 is shifted from the toner end sensor 22 to the upstream side in the direction indicated by arrow Y1, in which the screw 21*a* transports toner.

The toner container 70 of the supply device 160 is a typical cylindrical bottle. As illustrated in FIG. 2, a spiral groove is provided on an inner face of the toner container 70 to discharge toner from the right to the left in FIG. 2 as the toner container 70 rotates. A seal member 71 provided at en end of the toner container 70 includes an elastic body such as sponge. The seal member 71 fits, via a holder 61, the toner reservoir 60 and rotates while being in contact with the holder 61.

Figure 6A:
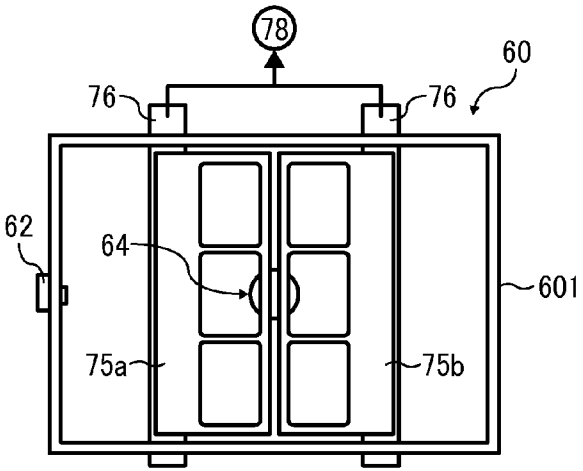
FIGS. 6A and 6B are respectively a plan view and a side view of a toner reservoir in the developing section shown in FIG. 2.
Figure 6B:
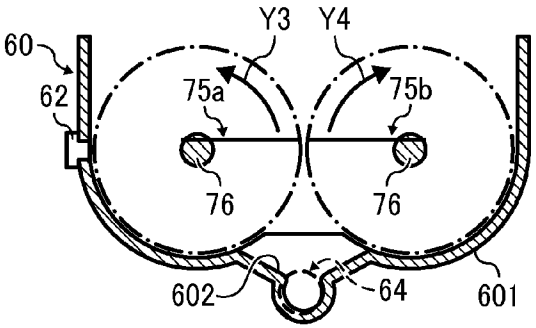
Figure 6C:
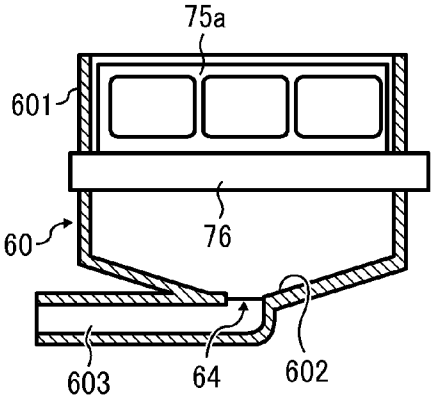
FIG. 6C is a cross-sectional view of the toner reservoir and corresponds to FIG. 2.

As shown in FIGS. 6A, 6B, and 6C, inside a casing 601 of the toner reservoir 60, a pair of planar paddles 75*a* and 75*b* (i.e., agitators) are provided in parallel to each other. Rotation shafts 76 of the planar paddles 75*a* and 75*b* are supported by the casing 601 rotatably. An agitator motor 78, serving as a driving source to drive the paddles 75*a* and 75*b*, is connected to the rotation shafts 76 to rotate the paddles 75*a* and 75*b* concurrently in the respective directions indicated by arrows Y3 and Y4 shown in FIG. 6B. Each of the planar paddles 75*a* and 75*b* includes thin plates that are either resin or metal and attached to the rotation shaft 76 that is either resin or metal similarly.

As shown in FIG. 6C, a bottom of the casing 601 of the toner reservoir 60 is conical and includes a conical face 602 sloped mildly to a center portion. An outlet 64 is provided to a deepest position in the center portion. The outlet 64 communicates, via a horizontal discharge channel 603, with a pipe 604 of the conveyance mechanism PD as shown in FIG. 2. An end of the pipe 604 is connected to the inlet 201 of the pump case 34. As shown in FIGS. 6A and 6B, the rotation shafts 76, to which the paddles 75*a* and 75*b* are attached, are shifted from the outlet 64 when viewed from above. Additionally, a toner sensor 62 is attached to a side face of the casing 601.

Next, a toner supply action is described below.

As the toner in the developing device 10 is consumed in image developing, a toner density sensor provided to a casing of the developing device 10 detects density of toner therein. When the density falls to or below a proper value, the controller 95 (shown in FIG. 1) issues a drive command to the rotation driving system, thereby driving the screws 21*a* and 21*b* of the sub-hopper 20. Then, toner is supplied from the screw 21*b* to compensate for the consumption. When the density of toner in the developing device 10 reaches a proper value, the screws 21*a* and 21*b* stop, and the controller 95 keeps the density of toner in the developing device 10 constant.

Meanwhile, as the toner in the sub-hopper 20 is supplied to the developing device 10, the toner end sensor 22 detects the decrease in the amount of toner in the sub-hopper 20. Then, the controller 95 drives the pump 30, and the pump 30 sucks in toner from the toner reservoir 60 and supplies toner to the sub-hopper 20. When the toner is supplied from the toner reservoir 60 to the sub-hopper 20, the toner sensor 62 detects the decrease in the amount of toner in the toner reservoir 60. Then. the controller 95 rotates the toner container 70 and stores toner in the toner reservoir 60. For example, the toner end sensor 22 and the toner sensor 62 can be piezoelectric level sensors and detect that no or almost no toner remains therein when the level (surface) of powdered toner descends in the sub-hopper 20 and the casing 601, respectively. The pump 30 has capability of flow rate of about 5 liters per minute at a maximum. For example, when the pump 30 is set to operate for 0.6 second in a single pumping action, 50 cc (5000/60×0.6) of toner can be sucked in or discharged at a maximum with a single pumping action.

Descriptions are given below of transport of toner to the sub-hopper 20 using the pump 30.

The developer sucked by the pump 30 is transported to the sub-hopper 20 situated above the developing device 10. The pump 30 is operated when the toner end sensor 22 detects a toner end state (i.e., developer end state) in the sub-hopper 20, meaning that the amount of toner (developer) therein falls below a predetermined amount to keep the amount of toner in the sub-hopper 20 substantially constant. Toner is stirred in the sub-hopper 20 and then transported further to the developing device 10.

In conveyance of toner using a positive-displacement pump, if the flowability of toner is low, inconveniences may arise in suction of the pump. Accordingly, it is preferred that toner thus transported have a higher degree of flowability. In other words, the bulk density of toner is low. When the bulk density of toner is extremely low, however, there is a risk that the sensor fails to detect the presence of toner on the detection face of the sensor immediately after the transport of toner. The sensor to detect the toner end state is designed to detect the presence of toner when receiving a predetermined amount of load or greater. If the flowability of toner (void rate) is extremely high, it is possible that the load is not applied to the sensor and the sensor erroneously judges that toner is not present.

In view of the foregoing, the developer conveyance device 190 according to the embodiment includes the positive-displacement pump 30 capable of avoiding erroneous detection caused when the flowability of toner is high and the void rate is high.

Figure 7:
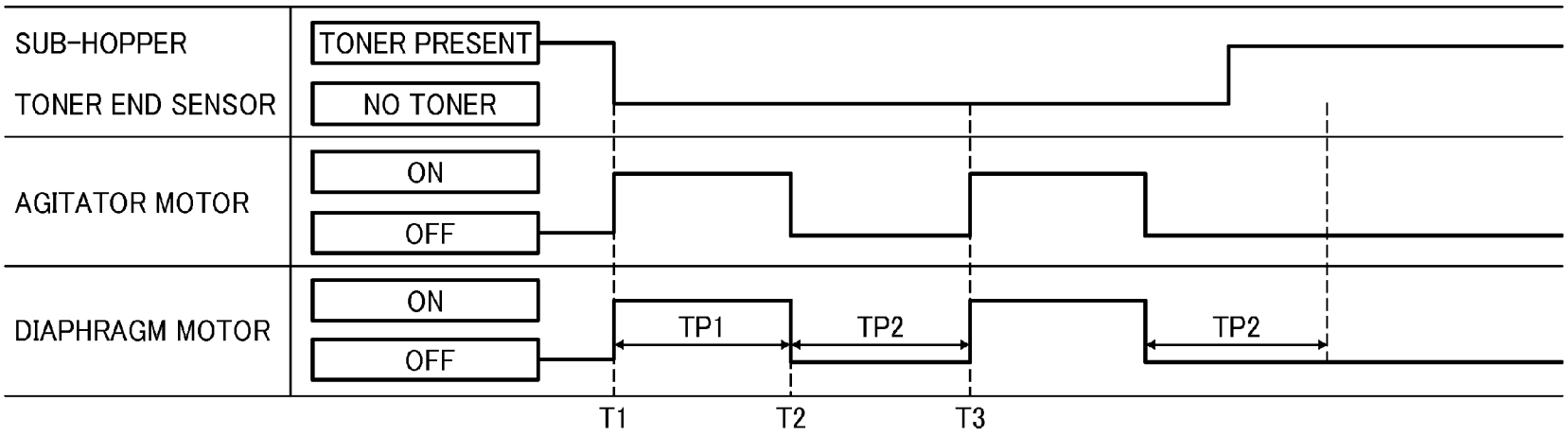
FIG. 7 is a timing chart illustrating a control procedure according to an embodiment, to transport toner to the sub-hopper shown in FIG. 3A.

Referring to FIG. 7, as toner is consumed in the developing process and the amount of toner in the sub-hopper 20 decreases, the toner end sensor 22 outputs a signal indicating "no toner" (L level) at time point T1. Then, the agitator motor 78 (shown in FIG. 6A) to drive the paddles 75*a* and 75*b* and the diaphragm motor 35 (shown in FIG. 2) to drive the pump 30 are turned on, thereby transporting toner from the toner container 70 to the sub-hopper 20. After the agitator motor 78 and the diaphragm motor 35 are driven for a period TP1, which is also referred to as the pump on time (operating time of the pump 30), these motors are stopped at time point T2 and kept at rest for a period TP2. At the time point T2 at which the agitator motor 78 and the diaphragm motor 35 are stopped, the toner end sensor 22 is at the low level and indicate that "no toner".

In addition to the period TP1 during which the pump 30 is on (pump on time), in the period TP2 during which the pump 30 is at rest, the controller 95 inhibits the toner end sensor 22 from detecting developer or neglects the output from the toner end sensor 22 (sensor data is made invalid). In other words, the controller 95 disables detection of toner (developer) by the toner end sensor 22 in the non-detection period that starts from the stop of the pump 30. Accordingly, the pump 30 and the screws 21*a* and 21*b* are not operated. The period TP2 is referred to as "non-detection period".

After the period TP2 (non-detection period), the output from the toner end sensor 22 is again checked at T3. When the output indicates "no toner", the pump 30 and the screws 21*a* and 21*b* are driven again to transport toner. The period during which detection of the toner end sensor 22 is disabled (the toner end sensor 22 does not detect toner or the output from the toner end sensor 22 is made invalid) is the sum of the period TP1 during which the pump 30 is on and the period TP2 (non-detection period).

Toner is still fluidized immediately after the pump 30 is stopped in addition to the period TP1 during which the pump 30 is on. Accordingly, even if toner is present on the detection face of the toner end sensor 22, it is possible that the toner end sensor 22 erroneously judges that toner is not present due to the characteristics of the toner end sensor 22. Therefore, there is a risk that, even after the pump 30 is driven for a given period and a proper amount of toner is supplied to the sub-hopper 20, toner is supplied to the sub-hopper 20 and toner overflows the sub-hopper 20 to the outside. Additionally, if the pump 30 operates in a state in which the sub-hopper 20 is filled with toner, the pump 30 pushes out toner from the sub-hopper 20 to the developing device 10, and an excessive amount of toner flows in the developing device 10. Moreover, there is a risk that air introduced by the pump 30 increases the internal pressure of the developing device 10, causing toner to scatter out. In the present embodiment, to inhibit these inconveniences, the toner end sensor 22 does not perform detection or the detection result is neglected (non-detection period is provided) until the flowing toner sinks and the bulk density of toner increases so that the toner end sensor 22 can detect the presence of toner.

Figure 8:
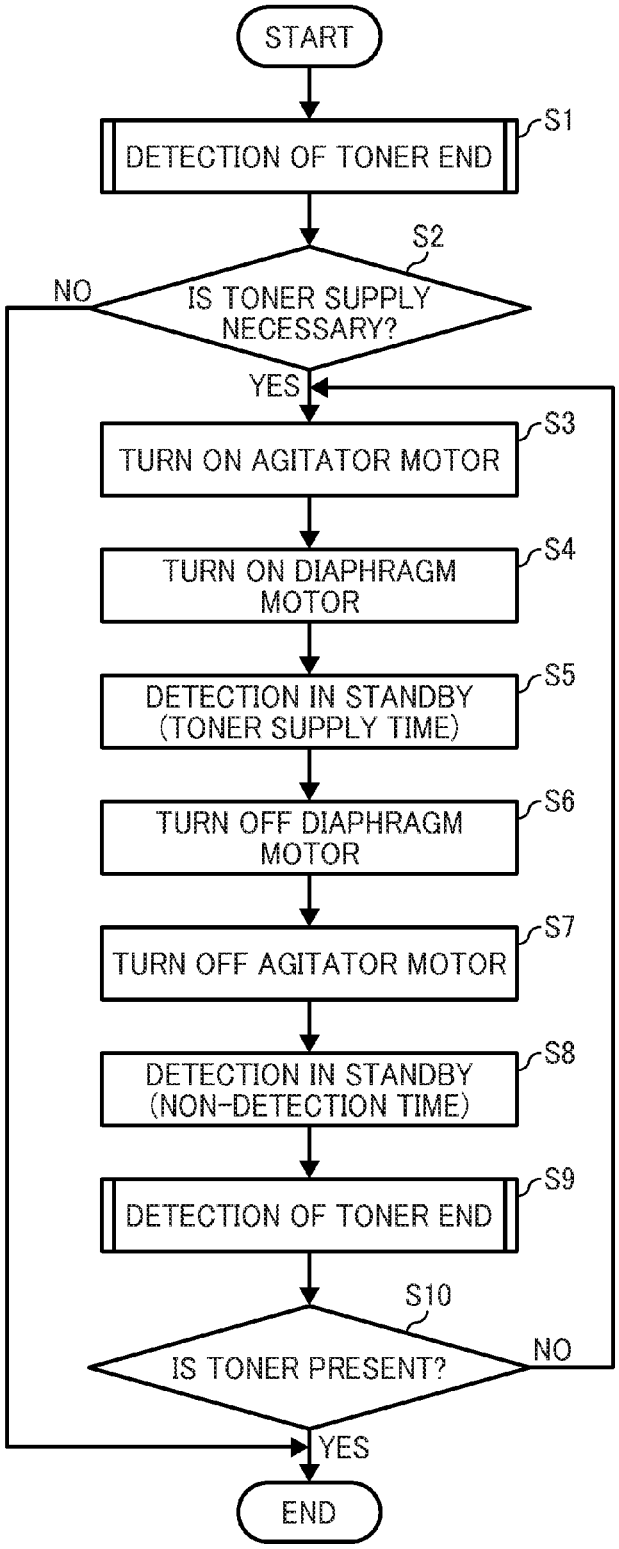
FIG. 8 is a flowchart of the control procedure shown in FIG. 7.

FIG. 8 is a flowchart illustrating a procedure to control the toner end detection and supply of toner described above.

At S1, the toner end sensor 22 detects the presence of toner in the sub-hopper 20. At S2, the controller 95 judges whether or not toner supply is necessary. When the signal output from the toner end sensor 22 indicates that toner is present (No at S2), the toner supply operation is completed. By contrast, when the toner end sensor 22 outputs the signal indicating that toner is not present (Yes at S2), toner supply is necessary. At S3, the agitator motor 78 is driven, and the diaphragm motor 35 is driven at S4. The agitator motor 78 and the diaphragm motor 35 are operated for the predetermined period (i.e., a toner supply time) and then stopped at S5. The pump 30 is on during the toner supply time (TP1 in FIG. 7), which is about 0.5 to 1 second in the present embodiment. After the diaphragm motor 35 and the agitator motor 78 are stopped at S6 and S7 (T2 in FIG. 7), during the non-detection period (TP2 in FIG. 7), which is about 2 seconds in the present embodiment, the toner end detection is not performed. In other words, detection is in standby. After the non-detection period elapses, at S9, the signal output from the toner end sensor 22 is read. When the signal indicates that toner is present (Yes at S10), the procedure to control toner end detection is completed. By contrast, when the signal indicates that no toner presents (No at S10), the process is repeated from driving of the agitator motor 78 and the diaphragm motor 35 (S3 and S4) to the toner end detection (S9).

It is to be noted that, when the flowability of toner decreases due to environmental changes, for example, to hot and humid conditions, the amount of toner transported decreases even if the capability of the pump 30 is identical. In this case, the operating time of the pump 30 is increased. Additionally, it is possible that the pressure of the pump 30 decreases due to degradation with time. In this case, to maintain the amount of toner transported at an initial stage of use, for example, the developer conveyance device 190 may be set such that the operating time of the pump 30 increases when the number of sheets printed reaches a predetermined number. Additionally, in a case where image density is increased at users' preference, the amount of toner adhering to sheets increases, and toner is consumed at a faster speed. Accordingly, the operating time of the pump 30 is increased. In a case where the operating time of the pump 30 increases, toner is further fluidized. In view of the foregoing, it is preferred to increase the non-detection period to inhibit erroneous detection of the toner end sensor 22. Specifically, the non-detection period is set in accordance with the operating time of the pump 30. In this case, as the operating time of the pump 30 becomes longer, the non-detection period is set to a longer period, and thus the sensor invalid period becomes longer.

Figure 9:
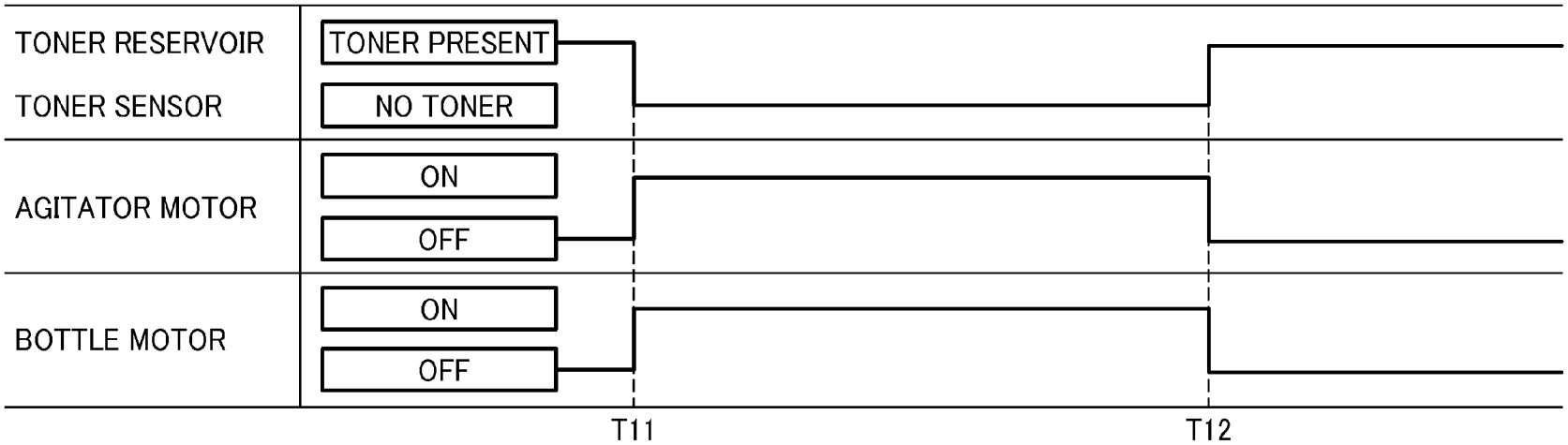
FIG. 9 is a timing chart illustrating a control procedure according to an embodiment, to discharge toner from a toner container to the toner reservoir shown in FIG. 6A.

By contrast, discharge of toner from the toner container 70 to the toner reservoir 60 is controlled as shown in a timing chart shown in FIG. 9.

At time point T11, when the toner sensor 62 provided to the toner reservoir 60 outputs a signal indicating that toner is not present on the detection face of the toner sensor 62, the toner container 70 is rotated, thereby discharging toner to the toner reservoir 60. At T12, when the detection face is buried in toner, the controller 95 judges that toner is present in the toner reservoir 60 and stops rotation of the toner container 70. In the procedure to control discharge of toner to the toner reservoir 60 shown in FIG. 9, the non-detection period is not provided, and the toner container 70 and the paddles 75*a* and 75*b*, which are the agitators of the toner reservoir 60, are driven until the toner sensor 62 outputs a signal indicating the presence of toner. The toner discharged by the rotation of the toner container 70 is not fluidized to the degree of the toner transported by positive-displacement pumps. Therefore, the possibility of erroneous detection of the toner sensor 62 is lower, and thus the non-detection period is not provided.

It is to be noted that the controller 95 may be a computer including a central processing unit (CPU) and associated memory units (e.g., ROM, RAM, etc.). The computer performs various types of control processing by executing programs stored in the memory. Field programmable gate arrays (FPGA) may be used instead of CPUs.

In short, in the control procedure according to the present embodiment, even if toner is not present on the detection face of the toner end sensor 22, a subsequent conveyance action is not performed until the predetermined period elapses after previous conveyance of toner.

According to an aspect of the above-described embodiment, while the developer transported by a pump has a higher degree of flowability and lower void rate in a destination, detection of toner in the destination is not executed. Accordingly, erroneous detection is inhibited, and the amount of toner stored in the destination is stabilized. This aspect is also advantageous in inhibiting leak of developer from the destination, resulting from excessive pumping actions, and excessive supply of toner from the destination to a further destination. Accordingly, internal pressure rise caused by pump air and scattering of developer are inhibited.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

a developer conveyance device to transport developer, the developer conveyance device including a positive-displacement pump to alternately generate positive pressure and negative pressure by changing a volume of an internal space thereof;

a destination developer container to which the developer conveyance device transports developer;

a sensor provided to the destination developer container to detect developer in the destination developer container; and a controller to control the positive-displacement pump according to a detection result of developer generated by the sensor, wherein the positive-displacement pump takes in air and developer and discharges the developer together with air to the destination developer container, and the controller disables detection of developer by the sensor in a non-detection period that starts from a stop of the positive-displacement pump, and wherein the controller disables the detection of developer by the sensor while the positive-displacement pump is operating.

2. The image forming apparatus according to claim 1, wherein a duration of the non-detection period is determined in accordance with an operating time of the positive-displacement pump.

3. The image forming apparatus according to claim 1, wherein the non-detection period is increased when an operating time of the positive-displacement pump is increased.

4. The image forming apparatus according to claim 1, wherein the destination developer container comprises a hopper to temporarily store developer, the positive-displacement pump is disposed above the hopper, and the sensor is attached to a side wall of the hopper and positioned to substantially coincide with a vertical face that passes through an outlet of the positive-displacement pump.

5. The image forming apparatus according to claim 4, wherein the outlet of the positive-displacement pump is at a position deviated upstream from the sensor in a direction in which developer is circulated in the hopper.

6. A developer conveyance device to transport developer to a destination developer container, the developer conveyance device comprising:

a sensor provided to the destination developer container, the sensor to detect developer in the destination developer container; and a positive-displacement pump to alternately generate positive pressure and negative pressure by changing a volume of an internal space thereof, the positive-displacement pump controlled according to a detection result generated by the sensor, wherein the positive-displacement pump takes in air and developer and discharges the developer together with air to the destination developer container, and wherein detection of developer by the sensor is disabled in a non-detection period that starts from a stop of the positive-displacement pump, and wherein the detection of developer by the sensor is disabled while the positive-displacement pump is operating.

7. The developer conveyance device according to claim 6, wherein a duration of the non-detection period is determined in accordance with an operating time of the positive-displacement pump.

8. The developer conveyance device according to claim 6, wherein the non-detection period is increased when an operating time of the positive-displacement pump is increased.

9. The developer conveyance device according to claim 6 wherein the positive-displacement pump is disposed above the destination developer container, and the sensor is attached to a side wall of the destination developer container and positioned to substantially coincide with a vertical face that passes through an outlet of the positive-displacement pump.

10. The developer conveyance device according to claim 9, wherein the outlet of the positive-displacement pump is at a position deviated upstream from the sensor in a direction in which developer is circulated in the destination developer container.

11. The image forming apparatus according to claim 1, wherein the controller is further configured to enable the sensor following a non-detection period which is a toner rest period during which the positive-displacement pump is inactive and the sensor is disabled.

12. The developer conveyance device according to claim 6, wherein the sensor is enabled following the non-detection period which is a toner rest period during which the positive-displacement pump is inactive and the sensor is disabled.

13. The image forming apparatus according to claim 1, further comprising a toner supply container connected to a toner inlet of the positive-displacement pump.

14. An image forming apparatus comprising:

a developer conveyance device to transport developer, the developer conveyance device including a positive-displacement pump to alternately generate positive pressure and negative pressure by changing a volume of an internal space thereof;

a destination developer container to which the developer conveyance device transports developer;

a sensor provided to the destination developer container to detect developer in the destination developer container; and a controller to control the positive-displacement pump according to a detection result of developer generated by the sensor, wherein the positive-displacement pump takes in air and developer and discharges the developer together with air to the destination developer container, and wherein the controller neglects output from the sensor in a non-detection period that starts from a stop of the positive-displacement pump, and wherein the controller neglects output from the sensor while the positive-displacement pump is operating.

* * * * *